US005577995A

United States Patent [19]

Walker et al.

[11] Patent Number: 5,577,995

[45] Date of Patent: Nov. 26, 1996

[54] SPINAL AND SOFT TISSUE MOBILIZER

[75] Inventors: Grace L. Walker, 2531 Crestview Dr., Newport Beach, Calif. 92663; Rex O. Bare, Lake Forest, Calif.

[73] Assignee: Grace L. Walker, Orange, Calif.

[21] Appl. No.: 77,323

[22] Filed: Jun. 14, 1993

Related U.S. Application Data

[63] Continuation of Ser. No. 714,516, Jun. 13, 1991, abandoned.

[51] Int. Cl.[6] ..... A61H 15/00

[52] U.S. Cl. ..... 601/120; 601/118

[58] Field of Search ..... 601/118–125, 128, 601/129, 131, 132, 133, 134, 135, 136, 137

[56] References Cited

U.S. PATENT DOCUMENTS

| | | | |
|---|---|---|---|
| D. 269,375 | 6/1983 | Masuda . | |
| 670,199 | 3/1901 | Eckardt | 128/57 |
| 896,484 | 8/1908 | Thoms | 128/57 |
| 2,221,785 | 11/1940 | Douglas | 601/120 |
| 2,286,324 | 1/1941 | Wentz | 128/57 |
| 3,003,497 | 10/1961 | Nunes | 128/57 |
| 3,298,687 | 1/1967 | Douglas | 601/120 |
| 3,419,268 | 12/1968 | Bellet | 128/57 |
| 3,612,043 | 11/1971 | Inaki . | |
| 3,616,794 | 11/1971 | Gromala | 128/57 |
| 3,750,654 | 8/1973 | Shiu | 601/121 |
| 3,756,224 | 9/1973 | Lyamon . | |
| 3,842,453 | 10/1974 | Redfield | 601/121 |
| 3,847,144 | 11/1974 | Wright | 601/120 |
| 3,972,322 | 8/1976 | Finn | 128/57 |
| 4,002,163 | 1/1977 | Jackson | 128/57 |
| 4,347,838 | 9/1982 | McCauley . | |
| 4,373,516 | 2/1983 | Masuda | 128/57 |
| 4,493,315 | 1/1985 | Iwahashi . | |
| 4,577,625 | 3/1986 | Lohati et al. . | |
| 4,648,387 | 3/1987 | Simmons . | |
| 4,699,127 | 10/1987 | Schley | 128/65 |
| 4,712,539 | 12/1987 | Kim . | |
| 4,785,800 | 11/1988 | Stilson | 601/121 |
| 4,832,006 | 5/1989 | Kirsch | 128/57 |
| 4,945,900 | 8/1990 | Masuda | 128/60 |

FOREIGN PATENT DOCUMENTS

| | | | |
|---|---|---|---|
| 9113605 | 9/1991 | WIPO | 128/57 |

*Primary Examiner*—Robert A. Hafer
*Assistant Examiner*—Brian E. Hanlon
*Attorney, Agent, or Firm*—Lyon & Lyon

[57] ABSTRACT

A therapeutic device to mobilize the spinal joints and soft tissues surrounding the human spine. The device includes two substantially solid spherical balls mounted on a shaft for independent rotation. In one embodiment, the balls have a spherical to elliptical configuration and comprise an inner ball portion of a variable density synthetic plastic material and with an outer covering or portion comprised of a flexible material. The balls have a confronting area forming a substantially elliptical shape extending from a major spherical ball portion. Another embodiment comprises two spherical rubber balls having an inner ball formed of hard material to assist in the mobilizing operation and an outer flexible rubber cover. In either embodiment, the balls may be mounted on the shaft via suitable sleeves disposed through the inner ball portions. The device may be used in self-treatment or may be applied by another person.

4 Claims, 4 Drawing Sheets

SPINAL AND SOFT TISSUE MOBILIZER

This is a continuation of application Ser. No. 07/714,516, filed on Jun. 13, 1991, now abandoned and which designated the U.S.

The present invention relates to the field of physical therapy, and more particularly to a device to mobilize the intervertebral joints and facet joints of the human spine.

BACKGROUND OF THE INVENTION

It is a common practice for physical therapists, chiropractors, and other medical practitioners to utilize various manual techniques to mobilize the joints of the spinal column, including the intervertebral joints, the synovial facet joints, the costovertebral joints, and the costotransverse joints. Such joint mobilization distends the joint capsule ligaments and reflexively relaxes the associated muscles. Synovial fluid, upon mobilization, will seep to areas of the articular cartilage surfaces to provide lubrication for the joints, decreasing pain and providing relief to the patient. The synovial fluid is pumped and shifted within the articular capsule of the joint by joint motions including flexion, extension, rotation, and a sliding action of the opposing joint surfaces relative to one another. Furthermore, the purpose of vertebral mobilization is to increase the intradiscal space between the vertebrae to allow for water diffusion and nutrition exchange within the vertebral segment (vertebrae-disc-vertebrae). When this happens, muscle spasms decrease, spinal mobility increases, and pain relief is achieved.

Physical therapists employ various hands-on techniques and forces to achieve the desired degree of joint mobilization. There are five grades of mobilization typically used:

Grades I and II are small amplitude movements performed at the beginning of range of motion at a given joint. The effect of these movements is to reduce pain by the aforementioned fluid movements. These movements are not sufficient to increase active range of motion.

Grade III is a large amplitude motion in the last half of range. This movement is sufficient to increase range of motion as well as decrease pain.

Grade IV is a small amplitude motion or a sustained pressure at the very end of range sufficient to stretch the joint at the point of resistance. The result is to increase range of motion to the limit of normal active range.

Grade V is a quick movement requiring a pressure fulcrum which produces a movement beyond the patient's active range of motion. It is sometimes called "popping" of the joints and is similar to the cracking of one's knuckles. In the spine, such hyperextension is useful to provide an immediate relief of pain and increase of normal active range.

One technique used by physical therapists to achieve joint mobilization is to have patients put two tennis balls in a sock and then knot them in the toe end. The patient is then instructed to place the thus contained tennis balls on the floor and move his or her back against them to achieve Grade III, IV or V mobilization.

Furthermore, soft tissue mobilization is a technique wherein the muscular tissues are physically moved relative to one another. The intent is to increase circulation of blood, stretch the muscle fibers and force fluids to exchange. Most importantly, soft tissue mobilization frees muscles from adherence to surrounding sheaths so that they can contract and relax freely again. A further intent of soft tissue mobilization is to decrease spasm of the muscles and to promote normal blood circulation.

Massage is a manual technique involving friction between the hand or a similar object and the skin. The skin may be moved against the underlying muscles in this action. The intent of massage is to increase surface circulation and cause a reflex generalized relaxation.

Joint mobilization, soft tissue mobilization, and massage can be accomplished by manual forces. In the case of the back, most of these techniques are difficult for patients to perform on themselves. Accordingly, there is a need for devices which can accomplish these techniques in an easy manner. Also, in order for a person to continuously apply a hands-on technique, a certain amount of strength and endurance is required. Thus, there is a need to develop therapeutic devices to supplement the hand.

When used as described, many prior devices are capable of accomplishing an adequate massage action as, for example, Layman U.S. Pat. No. 3,756,224, McCauley U.S. Pat. No. 4,347,838, Lohati et al. U.S. Pat. No. 4,577,625, Simmons U.S. Pat. No. 4,648,387, Gromala U.S. Pat. No. 3,616,794, Kim U.S. Pat. No. 4,712,539, Iwahashi U.S. Pat. No. 4,493,315 and Masuda U.S. Pat. No. Des. 269,375.

A common feature of most prior art massage devices is that they have complex contact surfaces, usually in the form of knobs and bumps, designed to produce multi-point stimulation of the skin. Most of these devices are made of hard, rigid materials, the purpose of which is to produce a sensory stimulation of the skin at many points simultaneously. Some of the therapeutic effects of massage may require a complex sensory input to the brain that appears to mask the perception of pain and allows muscle relaxation. None of these above referenced prior art devices are intended to produce appreciable joint mobilization.

Some prior art devices are designed primarily to produce soft tissue mobilization without affecting the underlying bones or joints. See for example, Kim U.S. Pat. No. 4,712,539 at column 1, lines 40–45. The device of this patent also is described as affecting so-called accupressure points in muscle tissues.

A massage device described in Iwahashi U.S. Pat. No. 4,493,315 is intended to provide therapeutic benefits by facilitating the circulation of blood via kneading actions (see column 1, lines 10–30). Other prior art devices use or incorporate wheel-like components to produce an effect on the muscles or the back to achieve relaxation. Examples are shown in the Gromala, Layman, Kim and Simmons patents discussed above. These devices can work on deeper muscle layers than can the purely massage-type devices, but they tend to have less aggressive contact surfaces. They employ smoothly rounded surfaces or resilient padding as in Iwashashi or tire-like contact surfaces as in Gromala. These devices may produce a degree of massage and soft tissue mobilization. However, if the goal is to produce significant mobilization of the joints, it is likely that bruising of the bones and other damage would occur if these devices were pressed hard enough to accomplish joint mobilization. For example, the Gromala patent, which is directed to muscle massage, cautions against using excessive force or use by a non-medically trained person (column 3, lines 1–5). Another example is the device of the Kim patent which is indicated to be specifically designed to avoid bone pressure (column 1, lines 40–45 and column 5, lines 1–5). The devices shown in the Iwashashi, Simmons, McCauley, Layman and Lohati patents were also designed to affect only muscles.

Further, most of the prior art devices are limited to application by another person and some suggest that significant medical training is necessary to avoid injuring the patient.

SUMMARY OF THE PRESENT INVENTION

The present invention is directed to an improved therapeutic device capable of both soft tissue mobilization and, more importantly, spinal joint mobilization without the risk of injury posed by prior art devices. The device can be utilized both by another person or by oneself.

The prior art devices, while suitable for massage of tissue and muscle, cannot achieve the desired spinal joint mobilization. It has been observed that manual techniques used to produce joint mobilization of the spine do so without causing the kind of damage that various of the prior art devices are likely to cause. An objective of the present invention is to develop a device capable of applying significant pressure to the vertebral structures without causing injury.

Devices constructed according to the present invention provide a soft-yet-firm contact, like from the heel of the hand (fat and muscle over bone), and which can be utilized by the patient with or without the assistance of a trained medical practitioner. Since the device is not primarily intended to provide a classical massaging action, the outer surface is smooth and free of multi-stimulation points characteristic of many of the prior art devices. It is preferable that the outer surface be of a relatively non-skid texture to prevent sliding, and to facilitate a rolling action. At the same time, the tractive surface preferably is smooth enough to prevent skin irritation.

BRIEF DESCRIPTION OF INVENTION

The present invention comprises a device for mobilizing the intervertebral joints and facet joints and other associated joints of the human spine, and one which also can mobilize soft tissue and muscles, and according to exemplary embodiments comprises a pair of substantially spherical balls mounted for rotation on a shaft which also forms two handles to be grasped by the operator. Each of the balls is formed of synthetic rubber or plastic material and comprises two basic components; namely, an inner ball preferably of spherical form and of a first harder material, and a second softer outer covering forming an outer ball. The inner harder ball is sufficiently hard to mobilize the joints, while the soft covering prevents bruising. In a first preferred embodiment the inner ball is of foam like material and the outer covering is flexible thereby forming a deformable or stretchable skin. The inner foam like ball is characterized by a changing density that increases upon compression and is sufficiently hard to mobilize the joints, while the flexible covering prevents bruising as noted above. The two balls are mounted adjacent each other for independent rotation with respect to one another. The inner ball provides resistance and compression to the otherwise flexible outer covering during mobilization. The soft outer covering distributes forces more evenly and in fact will produce a spreading force to the underlying tissue when pressed against the spine with enough force to distort or distend the material.

This combination of a variable density inner ball and a relatively flexible outer covering, and the independent rotation of the two balls, provides a sufficiently dense device for mobilization of the joints while minimizing or eliminating damage to the skin, soft tissue, muscles and joints. The combination of materials distributes force much like a compressed liquid or even the heel of the human hand. The mobilization can be achieved when the device is applied by the individual or applied by another person. Although the prior use of a pair of tennis balls in a sock has been helpful, this prior device cannot provide the same cushioned force, does not allow a smooth rolling action, and does not provide a spreading force action which is helpful in moving and mobilizing the spine. In a second embodiment, the inner ball is of a hard material, such as plastic, and the outer covering is of silicone. Thus, two embodiments of the present invention are shown and described herein.

Accordingly, it is a principal object of the present invention to provide a new form of spinal and soft tissue mobilizer.

Another object of this invention is to provide a new device for safely facilitating spinal mobilization.

A further object of this invention is to provide a device to mobilize the intervertebral joints and facet joints of the human spine.

BRIEF DESCRIPTION OF THE DRAWINGS

These and other objects and features of the present invention will become better understood through a consideration of the following description taken in conjunction with the drawings in which.

DETAILED DESCRIPTION

Figure 1:
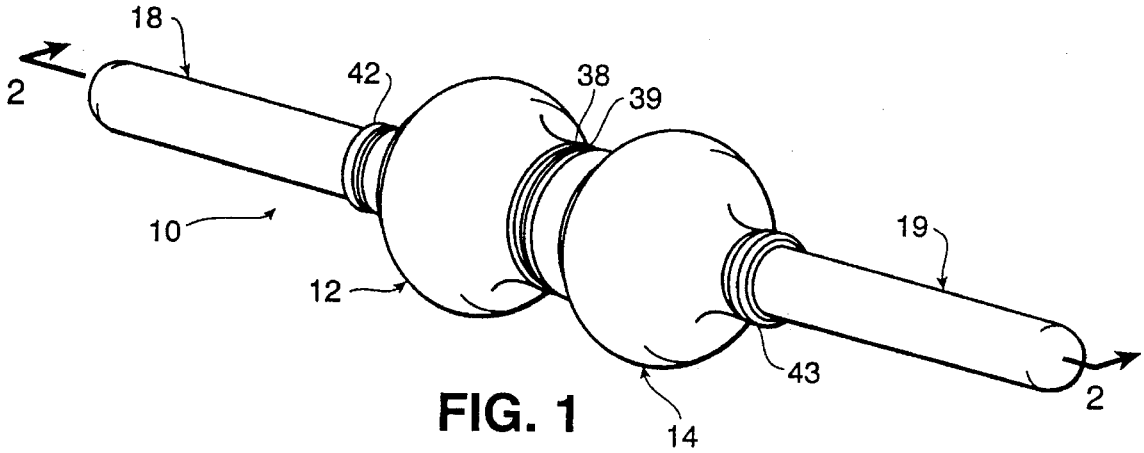
FIG. 1 is a perspective view of a first and preferred embodiment of the present invention.
Figure 2:
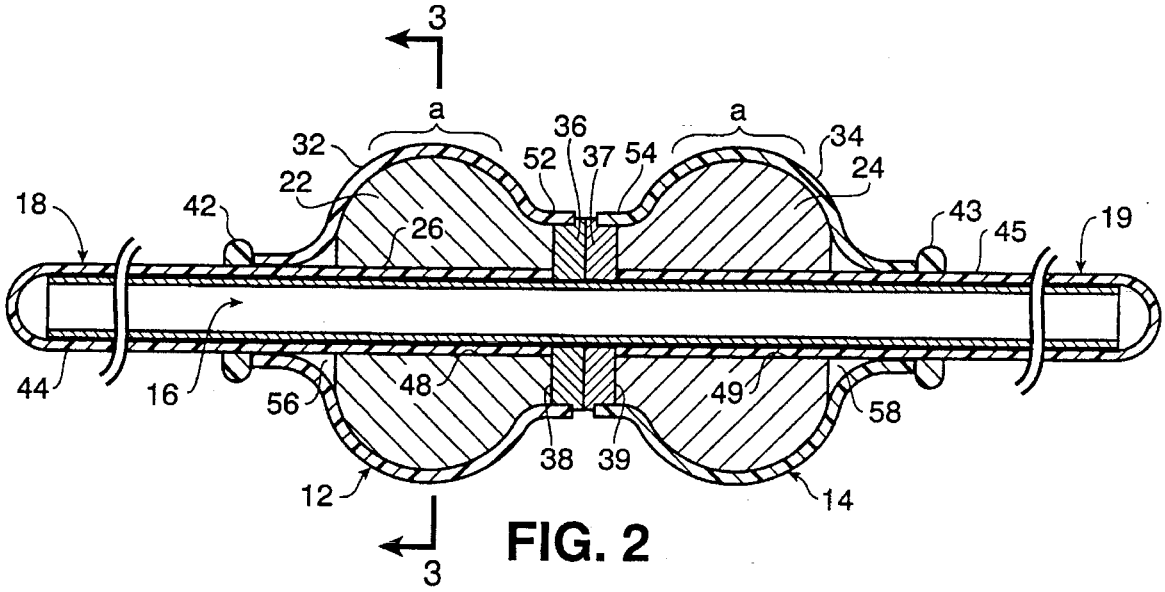
FIG. 2 is a longitudinal or axial cross-sectional view of the device of FIG. 1 taken along a line 2—2 of FIG. 1.
Figure 3:
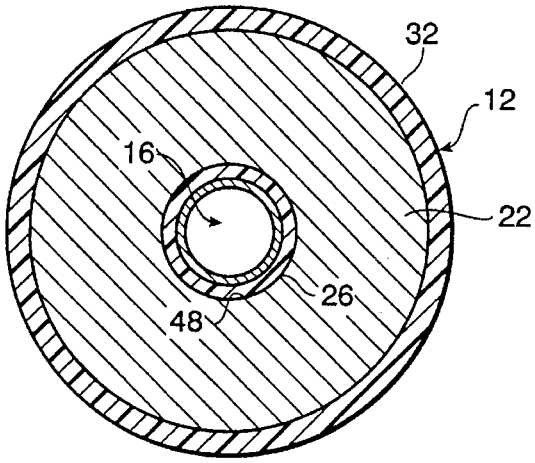
FIG. 3 is a transverse cross-sectional view thereof taken along a line 3—3 of FIG. 2.
Figure 4:
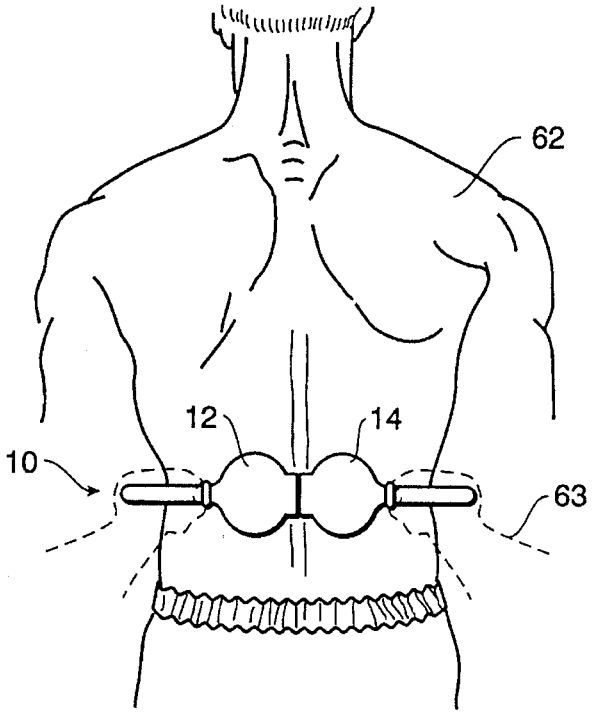
FIG. 4 is a simplified view showing use of the present device on the back of an individual by another person.
Figure 6:
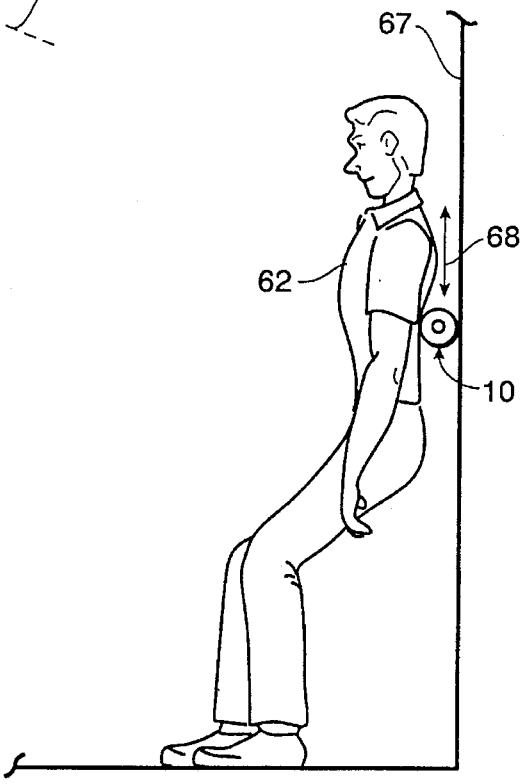
FIG. 6 is a simplified view showing how an individual can use a device of the present invention by rolling thereon along a wall.
Figure 5:
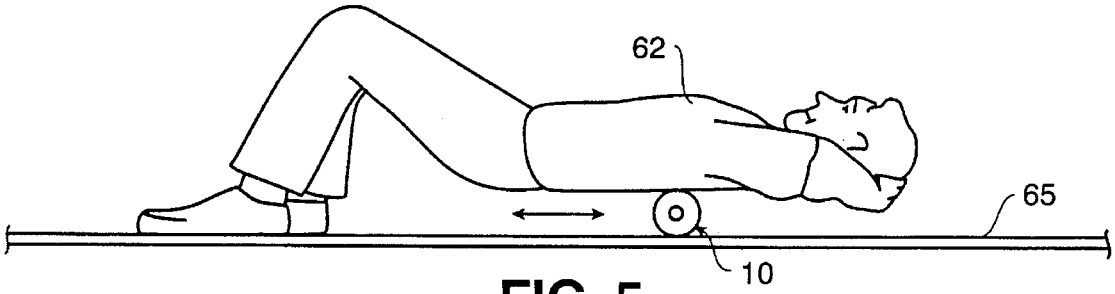
FIG. 5 is a simplified view showing how an individual can use a device of the present invention by rolling thereon on a floor.
Figure 7:
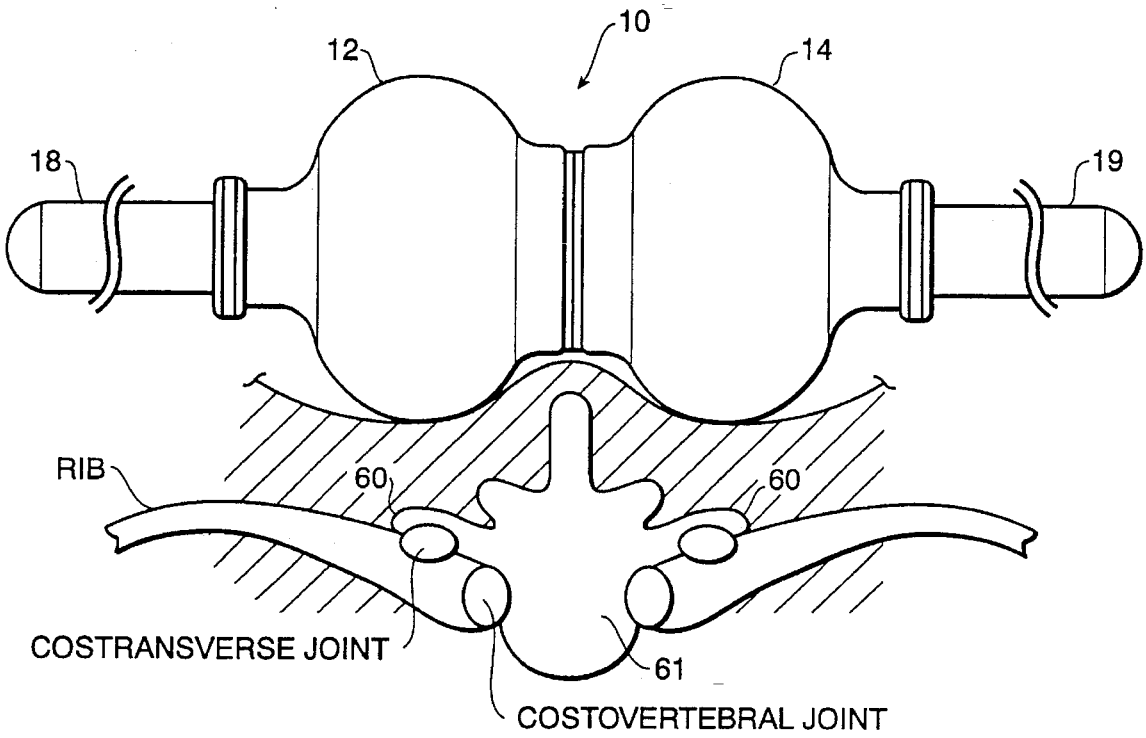
FIG. 7 is a simplified view illustrating how a device according to the present invention mobilizes the vertebra.
Figure 8:
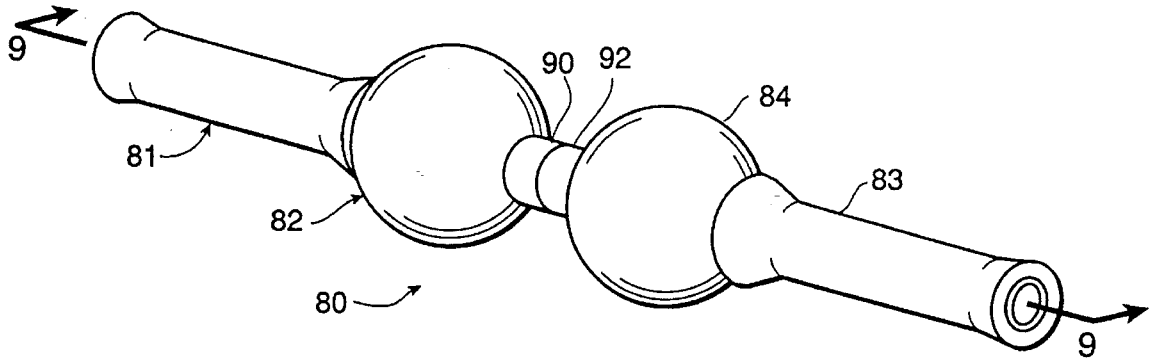
FIG. 8 is a perspective view of a second embodiment of the present invention.

Turning now to FIGS. 1 through 3, the same illustrate a first and preferred embodiment of the present invention. The mobilizer device 10 of the present invention comprises first and second substantially spherical balls 12 and 14 independently mounted on a shaft 16 (note FIG. 2) which also forms at its ends a pair of handles 18 and 19. As will be described in more detail subsequently, FIGS. 4–6 illustrate several different ways of using the mobilizer device 10, and FIG. 7 shows the relationship of the device to the spine.

Each of the balls 12 and 14 preferably is of identical construction. They comprise inner rotating balls 22 and 24 disposed on respective sleeves 26 and 28 which are disposed for rotation on the shaft 16. The inner balls 22 and 24 have an outer soft resilient covering 32 and 34, respectively. A pair of plastic washers or rings 36 and 37 are affixed to confronting faces 38 and 39 of the respective balls 22 and 24. Plastic collars 42 and 43 are similarly affixed to the outer ends of the balls 22 and 24. Resilient covers or sleeves are disposed on opposite ends of the shaft 16 to form the handles 18 and 19 to provide a resilient gripping surface for comfort of the operator in the mobilization treatment. The inner balls 22 and 24 preferably are formed of polyethylene foam or other suitable foam like plastic material, and the outer coverings 32 and 34 are formed of vinyl foam.

The sleeves 26 and 28 are secured within axial openings 48 and 49 of the inner balls 22 and 24 and are secured in any suitable manner, such as by a suitable adhesive. These sleeves facilitate rotation of the balls 22 and 24 and act as sleeve bearings on the shaft 16. Although the sleeves 26 and 28 and the washers 38 and 39 are shown as separate components that can be affixed to the respective balls 22 and 24, they can be integral or integrally molded with the balls 22 and 24, it only being necessary that some form of sleeve 26 and 28 be provided to form a relatively low friction bushing on the shaft 16, and the rings 38 and 39 be provided to form a relatively low friction confronting bearing surfaces for the two balls. The collars 42 and 43 preferably are fixed to the shaft 16 and form bearing surfaces between the handles 18 and 19 and balls 22 and 24 to prevent abrasion thereof and serve to retain or position the rotating sleeves 26 and 28. The handles can be in the form of resilient covers 44 and 45.

It will be noted that the configuration of the balls 12 and 14 of the FIG. 1–3 embodiment for the most part are spherical, but they smoothly form into almost an elliptical shape because of the large diameter confronting sections 52 and 54, as well as the outer but smaller diameter and thus less pronounced ends 56 and 58. This spherical to elliptical ball shape is provided for optimal mobilization of the areas about the spine, and is necessary to mobilize the facet joints of the spine. This particular shape enables forces to be applied to the transverse processes of the spine while clearing the midline spinous processes. The elongated confronting areas 52 and 54 also help space apart the major spherical portions of the balls 12 and 14 to facilitate an effective massaging action about the spinal area. In this regard, note FIG. 7 wherein the present device 10 is diagrammatically shown applied to the vertebrae 60 of the spine 61. Thus, the present device is designed so that the balls 12 and 14 straddle the spine and may be placed at the facet joint areas located about the spine.

The combination of the balls 12 and 14 and their shape result in an efficient mobilizing device which can effectively mobilize the facet and other joints, and yet can be used by the patient without the assistance of a medical practitioner. The outer layers or ball coverings 32 and 34 are easily compressed and provide elastic contact elements to the spinal area.

The device 10 of the present invention can be used in several ways either by the individual or by another. In this regard, FIG. 4 illustrates a patient 62 laying face down with an operator 63 applying the device 10 to the spinal area of the patient. Since the construction of the device 10 minimizes the risk of damage to the spine and other back areas, the operator may be a non-medical practitioner such as a spouse or friend of the patient. The device 10 is simply rolled up and down the back of the person being treated, with the balls 12 and 14 straddling the spinal area (note FIG. 7) and rotating so as to best mobilize the facet joints. The total force used is determined by the amount of weight applied to the handles 18 and 19.

FIG. 5 shows a person using the device 10 of the present invention by placing the device underneath his/her own back 62 and moving back and forth as indicated by an arrow 64 over the device 10 which rests on the floor 65. In this way, the spinal area of the person can be moved back and forth over the device 10 as the balls 12 and 14 rotate with respect to the back and the floor 65. FIG. 6 illustrates a similar arrangement wherein the device 10 is placed between the back of the person 62 and a wall 67. The person moves in the direction of the arrow 68 to cause the device 10 and the balls 12 and 14 to rotate along the wall 67 and the back in the spinal area. It should be noted that Grade I through IV mobilizations can be achieved with the operation as illustrated in FIG. 4, Grades III through V can be achieved using the operation of FIG. 5, and Grades II through IV can be achieved with the operation as illustrated in FIG. 6.

The outer covers 32 and 34 are compressed, as are the inner balls 22 and 24 to some extent, during the rolling action, but the degree of overall compression is limited by the hardness or density of the inner balls 22 and 24 resulting in effective treatment which does not bruise the patient and which is somewhat comparable to the cushioned pressure provided by the heel of the human hand but with a stretching and rolling action which is difficult to produce with the hand alone.

Turning again to the specific construction of the balls 12 and 14 of the device 10, the inner balls 22 and 24 comprise the major portions of the respective balls 12 and 14. The balls 22 and 24 are solid spheres and preferably may be molded of a soft plastic material such as closed microcellular polyurethane foam, and can have a density of one-half pound per cubic foot to five pounds per cubic foot, preferably one pound per cubic foot to 2 pounds per cubic foot, and most preferably one and one-half pounds per cubic foot. The outer coverings 32 and 34 are of a flexible material, such as rubber, leather or vinyl foam. Preferably the coverings 32 and 34 are cast onto the respective inner balls 22 and 24 and are of a resilient form of closed cell foam; alternatively the coverings may be produced by dip molding over a suitable mandrel and subsequently stretched over the inner balls 22 and 24. Each outer layer 32 and 34 is relatively thin as compared to the balls 22 and 24, and an exemplary thickness is about one-sixteenth inch to one-fourth inch, preferably one eighth inch to three-sixteenths inch, and represents approximately three to five percent of the total thickness of the entire balls 12 and 14. As noted earlier, the enlarged diameter confronting end portions 52 and 54 are provided to insure that there is suitable space between the balls so that the apex or circumferential areas thereof contact the facet joints, and to reduce the depth (toward the shaft 16) between the balls. For example, the apex areas identified as "a" of each of the balls 12 and 14 and which forms the principal portions thereof which contact the person being treated have a diameter of approximately three and one-half inches and are spaced approximately two to six inches apart, and preferably are about three and one-fourth inches to four inches apart for the general population. For small persons who do not fit the size parameters of the general population, especially dimensioned and spaced balls may be provided.

It is believed that the spherical to elliptical configuration shown in FIGS. 1 and 2 is the most preferred configuration inasmuch as narrow disc shaped devices such as shown in the Gromala patent are believed to present a harsh or dangerously small contact area with the potential for substantial bruising of the muscles. On the other hand, while a flattened "rolling pin" shape provides the maximum contact area and may provide maximum safety as in the Simmons patent, it cannot sufficiently penetrate to manipulate or mobilize the intervertebral joints and facet joints of the spine. Thus, the spherical shape of the principal contact areas provided by the balls 12 and 14, along with the diameter of confronting inner portions 52 and 54 which results in what is termed herein a "spherical to elliptical" shape is believed to be a significant improvement over devices of the prior art.

ALTERNATIVE EMBODIMENT

FIGS. 8 through 11 illustrate an alternate embodiment of a spinal and soft tissue mobilizer according to the present invention. As will be apparent from these Figures and the following discussion, the major differences are that the balls in this embodiment have a substantially spherical or elliptical cross section and comprise relatively hard inner balls formed of metal, wood or hard plastic, and an outer resilient cover of a soft material such as silicone. While the construction is useful and desirable, it has higher manufacturing costs than the first embodiment of FIGS. 1–3.

The device 80 shown in FIGS. 8 through 11 comprises a pair of spherical or elliptical cross section balls 82 and 84 suitably mounted on a shaft 85 and provided with handles 81 and 83. The balls 82 and 84 comprise inner and relatively hard solid spherical balls 86 and 88 respectively, mounted on the shaft 85 via cylindrical sleeves 90 and 92. Outer resilient covers 94 and 96 are provided on the respective balls 86 and 88. The ends of the shaft 85 are provided with the handles 81 and 83 in the form of rubber handles for comfort of the operator. In this embodiment, the inner ends of the sleeves 90 and 92 abut at 98, and are retained confronting by means of C-clips 100 and 101 (note in particular FIG. 11) or other suitable means at the outer ends of the respective sleeves 90 and 92. The sleeves 90 and 92 extend completely through the balls 82 and 84 and, thus, extend completely through the spherical inner balls 86 and 88 and the respective resilient covers 94 and 96, and thus the sleeves 90 and 92 act as sleeve bearings between the balls 82 and 84 and the shaft 85. This allows the balls 82 and 84 to rotate freely and independently on the shaft 85 as in the first embodiment. While the sleeves 90 and 92 are shown as separate members from the balls 82 and 84, they can be formed integrally therewith, such as being formed integrally with the inner balls 86 and 88.

Figure 9:
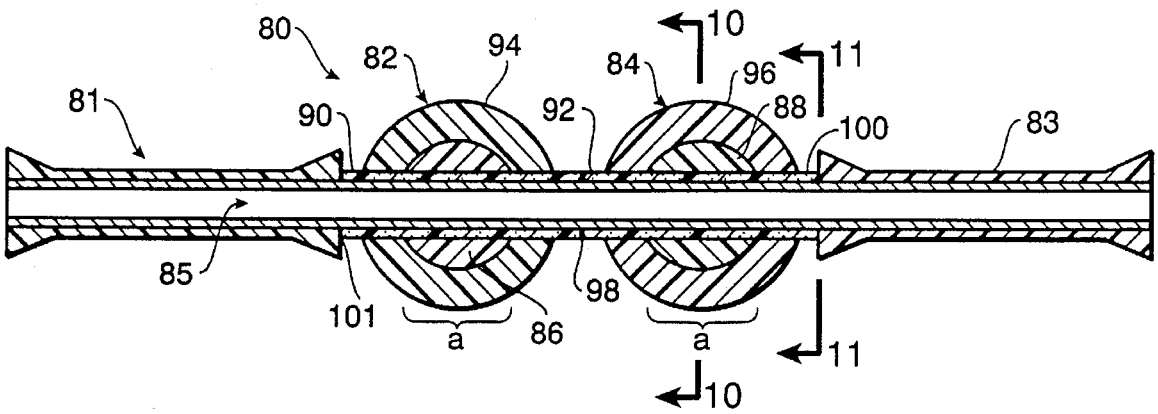
FIG. 9 is a longitudinal cross-section view thereof taken along a line 9—9 of FIG. 8.
Figure 10:
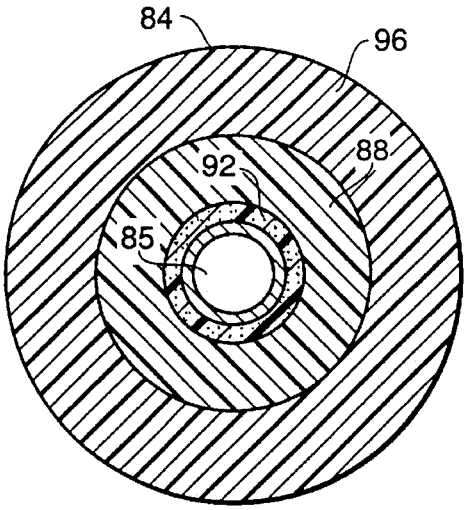
FIG. 10 is a transverse cross-sectional view taken along a line 10—10 of FIG. 9.
Figure 11:
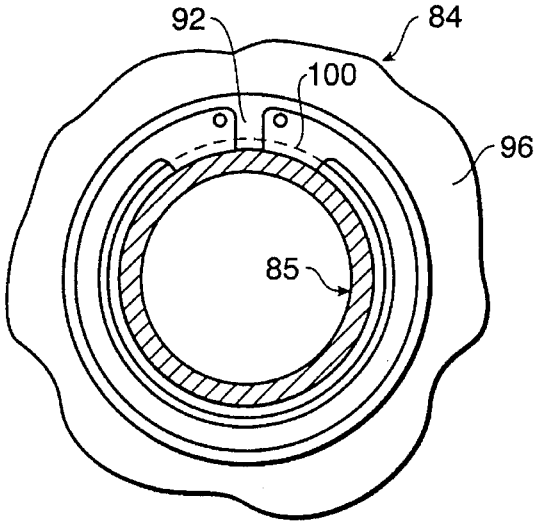
FIG. 11 is a transverse cross-sectional view thereof taken along a line 11—11 of FIG. 9.

As can be seen, particularly from FIGS. 9 and 10, the soft outer coverings 94 and 96 surround the concentrically located inner balls 86 and 88. The outer covers 94 and 96 are composed of synthetic rubber, and preferably they are formed of silicone. Alternatively, a vinyl or urethane rubber can be used for the coverings 94 and 96. The purpose of the outer covers 94 and 96 is to provide resilient coverings which are soft enough so that the spine is not bruised during treatment. An example hardness or durometer rating for the coverings 94 and 96 preferably ranges from Shore A-5 to A-30, preferably from A-10 to A-20. It has been found that generally Shore A-31 is too hard and A-4 is too soft. It is important that the balls 82 and 84 be sufficiently resistant so that they can effectively pressurize and mobilize the spine, yet be sufficiently elastic and soft so that bone bruising is minimized. As noted earlier, the inner balls 86 and 88 can be made of hard material, such as metal, wood or hard plastic. For example, a hard polyurethane is suitable, as is an acetal plastic sold under the trademark Delrin. The hard inner balls need not be of solid cross section, but they may be composed of closely spaced ribs or posts approximately of a ball shape if preferred for molding reasons. The sleeves 90 and 92 act as bearings with respect to the shaft 85 for rotation of the balls 82 and 84, but if a sufficiently hard material is used for the balls 86 and 88, separate sleeves 90 and 92 can be omitted. The sleeves, if used, preferably are formed of a hard plastic, such as polyethylene, and it is desirable that the same have a low coefficient of friction with respect to the material of the shaft 85. The shaft 85 can be composed of any suitable material, such as aluminum, steel, wood or plastic. Aluminum is preferable, because of its lightness and stiffness, but steel tubing is less expensive.

With respect to exemplary sizes, the balls 82 and 84 preferably have a diameter of one and one-half inches to three and one-half inches, and preferably about three inches. A three inch diameter ball is small enough to suitably work the muscles on either side of the spine, but large enough to provide knuckle clearance for the fingers of the operator around the handles 81 and 83. As is the case with the embodiment of FIG. 1, the balls 82 and 84 are spaced apart sufficiently so that both sides of the spine can be worked simultaneously. A spacing between the apexes "a" preferably is the same as that for the FIG. 1 embodiment, namely preferably three and one-half inches to four inches (or likewise measured between the centers of each of the balls 82 and 84). The size of the inner balls 86 and 88 depends on the desired outside diameter of the balls 82 and 84, but typically the diameter of each of the inner balls 86 and 88 is one and one-half inch. The outer covers 94 and 96 typically are one half to three-fourths inch thick.

The device 80 is used in the same manner as the device 10 of FIG. 1. In the case of use by a therapist or another person as illustrated in FIG. 4, the patient is simply placed on his or her stomach, and the therapist or other person rolls the device 80 along the patient's back along the spine. The balls 82 and 84 are placed about the spinal area so that both sides of the spine are worked simultaneously. The total force used is determined by the amount of weight applied to the handles 81 and 83. Similarly, the patient may place the device on the floor as shown in FIG. 5 or against a wall as shown in FIG. 6 to effectuate the rolling action and consequent mobilization. The outer covers 94 and 96 of the balls 82 and 84 are compressed during the rolling action. However, the degree of compression is still limited by the inner hard balls 86 and 88, resulting in an effective treatment which does not bruise the patient and which is somewhat comparable to the cushioned pressure provided by the heel of the human hand but with a stretching and rolling action which is difficult to produce with the hand alone.

While embodiments of the present invention have been shown and described, various modifications may be made without departing from the scope of the present invention, and all such modifications and equivalents are intended to be covered.

What is claimed is:

1. A self-usable device for mobilizing soft tissue, intervertebral joints, and facet joints of a human spine comprising a pair of substantially spherical independently rotatable rollers mounted on a shaft, the rollers being spaced apart by a fixed distance sufficient to straddle a human spine area and being sized to mobilize the soft tissue, intervertebral joints, and facet joints of the human spine, each roller having a core comprising closed cell microcellular polyethylene foam and a resilient cover comprising vinyl foam substantially covering the entire core, the rollers being able to smoothly form into a substantially elliptical shape for enabling mobilizing the soft tissue, intervertebral joints, and facet joints of a spine, and the shaft having two end portions extending beyond the rollers thereby forming a pair of handles for facilitating the user placing the device adjacent the spine area to mobilize the soft tissue, intervertebral joints, and facet joints.

2. A self-usable device for mobilizing soft tissue, intervertebral joints, and facet joints of a human spine comprising a pair of substantially spherical independently rotatable rollers mounted on a shaft, the rollers being spaced apart by a fixed distance sufficient to straddle a human spine area and sized to mobilize the soft tissue, intervertebral joints, and facet joints of the human spine, each roller having a core and a resilient cover, the core comprising closed cell microcellular polyethylene foam for providing firmness and resistance for enabling forces to be applied to the transverse processes of the spine while clearing the midline spinous processes, the resilient cover comprising vinyl foam substantially covering the entire core so as to provide elastic contact surfaces and sufficient padding to enable the device to mobilize the soft tissue, intervertebral joints, and facet joints of the spine while preventing bruising and producing a spreading force, and the shaft having two end portions extending beyond the rollers thereby forming a pair of handles for facilitating the user placing the device adjacent the user's spine area.

3. The device of claim 2 wherein the resilient cover is between one-sixteenth to one-fourth of an inch thick.

4. A spinal soft tissue and joint mobilizer comprising a pair of substantially spherical rollers independently and rotatably mounted on a shaft which ends in handles and having low friction confronting surfaces between the rollers and the shaft, between the rollers themselves, and between the rollers and the handles, each roller comprising a closed cell microcellular polyethylene foam inner core having density to provide resistance for mobilizing soft tissue, intervertebral joints, and facet joints and a vinyl foam resilient outer covering substantially covering the core and sufficiently flexible to enable mobilizing soft tissue, intervertebral joints, and facet joints, and spreading forces while preventing bruising, and each roller having an apex at a point furthest away from the shaft, a diameter of approximately three and one-half inches at the apex, and fixed spacing of approximately two to six inches apart as measured at said apexes.

* * * * *